United States Patent [19]

Nakashima

[11] Patent Number: 4,974,817

[45] Date of Patent: Dec. 4, 1990

[54] METAL MELTING AND HOLDING FURNACE

[75] Inventor: Mitsukane Nakashima, Nagoya, Japan

[73] Assignee: Meichuseiki Kabushiki Kaisha, Nagoya, Japan

[21] Appl. No.: 399,127

[22] Filed: Aug. 28, 1989

[30] Foreign Application Priority Data

May 29, 1989 [JP] Japan ..... 64-135400

[51] Int. Cl.[5] ..... F27B 3/04

[52] U.S. Cl. ..... 266/217; 266/225; 266/900; 266/901

[58] Field of Search ..... 266/217, 225, 900, 901

[56] References Cited

U.S. PATENT DOCUMENTS 3,650,730 3/1972 Derham et al. ..... 75/68 R 4,052,199 10/1977 Mangalick ..... 75/68 R

FOREIGN PATENT DOCUMENTS 56077 3/1984 Japan ..... 266/901

*Primary Examiner*—Melvyn J. Andrews

*Attorney, Agent, or Firm*—Armstrong, Nikaido, Marmelstein, Kubovcik & Murray

[57] ABSTRACT

A continuous melting furnace in which a metal is melted, so that the melted metal is held to maintain the temperature of the melted metal and is ladled to a mold, comprising a melting tower chamber for receiving metal to be melted and for melting such metal, an inclined floor chamber connected to the melting tower chamber, a holding chamber connected to the inclined floor chamber, a gas treatment chamber connected to the holding chamber and having a bubbling device for ejecting an inert gas into the melted metal and a ladling chamber connected to the gas treatment chamber and which is bounded to the holding chamber through a thermally insulative separation wall from which the melted metal is ladled into a mold.

14 Claims, 3 Drawing Sheets

METAL MELTING AND HOLDING FURNACE

BACKGROUND OF THE INVENTION

1. Field of the Invention

The present invention relates to a furnace for melting a metal, such as aluminium and holding the melted metal, and more precisely it relates to a continuous melting and holding furnace.

2. Description of the Related Art

There is a known metal melting furnace which melts a metal and holds the melted metal in a holding chamber, so that the melted metal held in the holding chamber can be ladled out from a ladling chamber into a mold, as disclosed, for example in Japanses Examined Patent Publication No. 62-23234 which was filed in the name of the assignee of the present application. In the known furnace as mentioned above, it is very difficult to control the quality of the melted metal which is ladled from the ladling chamber into the mold.

Namely, first, it is necessary to effectively remove hydrogen gas contained in the melted metal therefrom. Second, it is very important to control the temperature of the melted metal ladled from the ladling chamber. In other words, it is significant to prevent a reduction of temperature of the melted metal. These requirements are important not only from the viewpoint of quality control but also from the viewpoint of effective utilization of energy.

To remove hydrogen or other undesirable gas, it is known to provide in the ladling chamber a bubbling device which ejects an inert gas into the melted metal. However, a space for providing the bubbling device in the ladling chamber is restricted, and accordingly no effective ventilation (gas removal) effect can be expected.

There is a temperature difference of about 100° C. of the melted metal between the ladling chamber and the holding chamber. Therefore, in practice, the temperature of the melted metal in the holding chamber is controlled to be higher by 100° C. than that in the ladling chamber. This however results in an increased enegy consumption and an increased cost of operation of the furnace.

The primary object of the present invention is therefore to provide a compact continuous metal melting furnace in which the quality control of a melted metal, particularly, the ventilation can be easily effected to control the temperature at a desired value.

SUMMARY OF THE INVENTION

To achieve the object mentioned above, according to the present invention, there is provided a continuous melting furnace in which a metal is melted, so that the melted metal is held in a holding chamber to maintain the temperature thereof and is ladled therefrom into a mold, comprising a gas treatment chamber which is connected to the holding chamber and which has a bubbling device for ejecting an inert gas into the melted metal, and a ladling chamber which is connected to the gas treatment chamber and which bounds on the holding chamber through an insulating separation wall.

BRIEF DESCRIPTION OF THE DRAWINGS

The invention will be described below in detail with reference to the accompanying drawings, in which.

The illustrated embodiment is directed to a continuous furnace which melts an aluminium material and holds the melted aluminium in a holding chamber, so that the melted aluminium can be ladled from the holding chamber into a mold.

Figure 1:
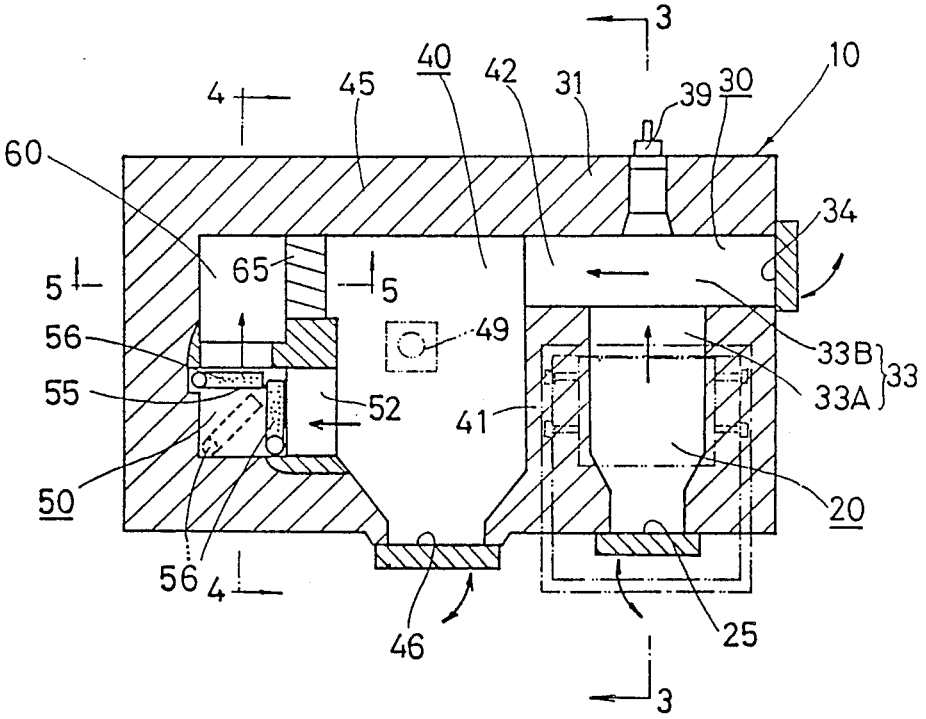
FIG. 1 is a cross sectional view of an aluminium melting and holding furnace according to an embodiment of the present invention.

The furnace has a furnace body 10 as shown in FIG. 1. The furnace body 10 which is made of rigid refractories has a melting tower chamber 20 which preheats the material to melt the same, an inclined floor chamber 30 in which the melted metal flows down while being heated, a holding chamber 40 for holding the melted metal, a gas treatment chamber 50 which is connected to the holding chamber and which has a bubbling device which ejects an inert gas into the melted metal, and a ladling chamber 60 which is connected to the gas treatment chamber and which is bounded by the holding chamber through a thermally insulative separation wall 65.

Figure 2:
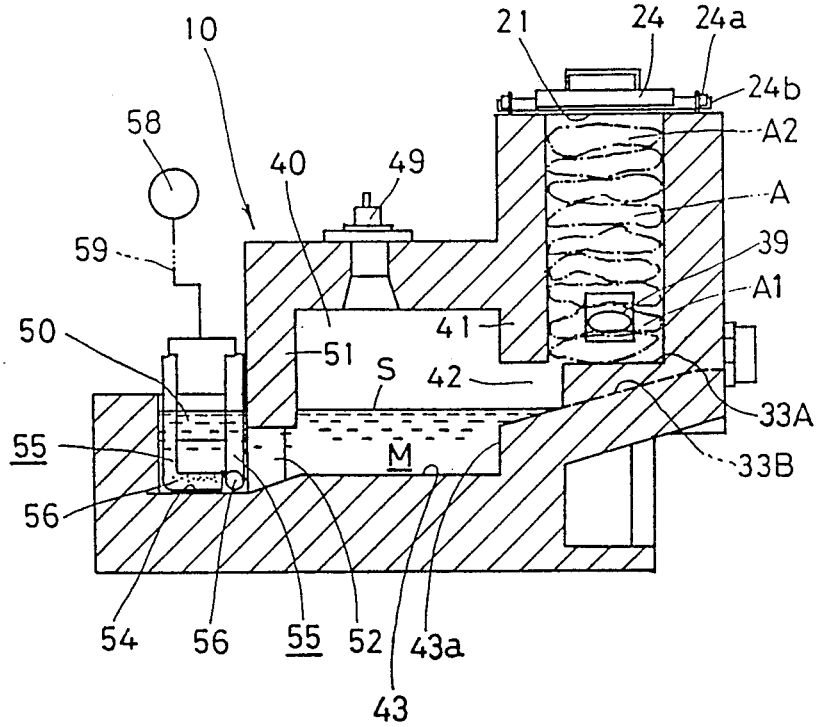
FIG. 2 is a longitudinal sectional view of FIG. 1.

A metal to be melted, e.g. an aluminium material A, such as an aluminium ingot is introduced in the melting tower chamber 20 which is in the form of a tower or cylinder, so that the metal material can be stacked in the form of a tower or the like. The melting tower chamber 20 is provided on its upper portion with a metal port 21 from which the metal material A is poured in the melting tower chamber 20, as shown in FIG. 2. Numeral 24 designates a cover which closes the inlet port 21. The cover 24 has wheels **24*a* which are rotatable on and along guide rails 24*b* provided on the furnace body 10 to open and close the cover 24. Numeral 25** designates a window through which an operator can inspect the inside of the furnace.

Figure 3:
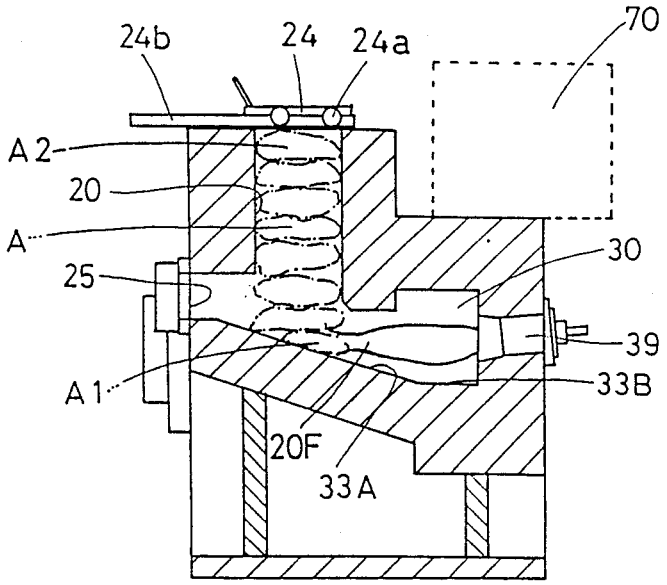
FIG. 3 is a sectional view taken along the line 3—3 in FIG. 1.

As shown in FIGS. 2 and 3, a lower portion A1 of the aluminium material A stacked in the melting tower chamber 20 is melted by the heat gas (including a burner flame) of a melting burner 39. An upper portion A2 of the aluminium material A stacked in the melting tower chamber 20 is preheated by the combustion exhaust gas in the furnace including the exhaust gas of the melting burner 39.

The melting tower chamber 20 has at its front lower portion an opening 20F, FIG. 3, which faces into the inclined floor chamber 30, so that the melted metal (which includes a flowable semi-melted material can be discharged into the inclined floor chamber 30 through the opening 20F.

The melting burner 39 is provided on the side wall 31 of the inclined floor chamber 30, so that the burner 39 is orientated toward the lower portion of the melting tower chamber 20.

The inclined floor chamber 30 has an inclined floor surface 33 along which the metal melted in the melting tower chamber 20 flows down into the holding chamber 40. In the illustrated embodiment, the inclined floor surface 33 has a first inclined surface portion 33A which linearly extends forward and downward from the front opening 20F of the melting tower chamber 20 and a second inclined surface portion 33B which is connected to the first inclined surface portion 33A and which is bent at right angle from the first inclined surface portion 33A in the left hand direction in FIG. 1. The second inclined surface portion 33B which is bent at right angle not only contributes to a realization of a compact furnace, thus resulting in an increased thermal efficiency of the melting burner 39, but also prevents a relatively cold material A in the melting tower chamber 20 from flowing down along the inclined surface 33 into the holding chamber 40.

The aluminium material melted in the melting tower chamber 20 is heated by the melting burner 39 during the downward movement thereof along the inclined floor surface portion 33A and 33B of the inclined floor surface, so that a high quality melted metal can be introduced in the holding chamber 40. An operator can check the melted metal in the furnace through a visible window 34.

The holding chamber 40 reserves the melted metal M to maintain the temperature thereof. Namely, the holding chamber 40 bounds on the inclined floor chamber 30 through an insulating separation wall 41. The holding chamber 40 has an opening 42 through which the melted metal flowing down in the inclined floor chamber 30 can be fed in the holding chamber 40.

The holding chamber 40 has a floor 43 which is lower than the inclined floor surface 33. Preferably, the floor 43 is connected to the inclined floor surface 33 through a stepped portion **43*a*, as shown in FIG. 2. The stepped portion 43*a* prevents the melted metal M which would otherwise flow out from the holding chamber 40 onto the inclined floor surface 33 from coming into contact with the melted metal having a lower temperature on the inclined floor surface 33**, or in the worst case, with the cold metal before melted, forced onto the inclined floor surface, thus resulting in a decrease of temperature of the melted metal or a production of gases.

In the holding chamber 40 is provided an additional burner 49 which maintains the temperature of the melted metal M in the holding chamber 40. In the illustrated embodiment, the burner 49 is provided in the ceiling 44 of the holding chamber 40. Alternatively, it is also possible to provide the burner 49 in the side wall 45 of the holding chamber 40, in place of in the ceiling 44 thereof. Numeral 46 in FIG. 1 designates a window through which an operator can inspect or operate.

The gas treatment chamber 50 is an independent chamber in which hydrogen or the like contained in the melted metal is removed therefrom to obtain a high quality melted metal for a die-casting.

The gas treatment chamber 50 is bounded by the holding chamber 40 through an insulating separation wall 51. The gas treatment chamber 50 has a lower connecting port 52 provided in the separation wall 51. The connecting port 52 is lower than the surface level S of the melted metal M reserved in the holding chamber 40 in a normal state. This prevents impurities, such as oxide, floating on the surface of the melted metal from flowing in the gas treatment chamber 50 and the ladling chamber 60. This also prevents the heat gas of the additional burner 49 from blowing outside from the holding chamber 40, thus resulting in a decreased noise due to the burner.

The bubbling device 55 is provided in the gas treatment chamber 50 to eject an inert gas into the melted metal in order to remove the gas contained in the melted metal, such as hydrogen gas together with the inert gas from the melted metal. The bubbing device 55 has perforated pipes 56 located on the bottom 54 thereof to eject an inert gas, such as nitrogen gas or argon gas into the melted metal in order to disperse the ejected inert gas together with the gas contained in the melted metal from the surface of the melted metal, as shown in FIG. 2. In theory, only one perforated pipe 56 can be provided, but preferably, more than one perforated pipes 56 are provided to effectively disperse the gas. It is possible to provide a rotary type bubbling device (or devices) having a rotor or rotors (nozzle or nozzles) which rotates or rotate at high speed to disperse and eject an inert gas therefrom. Numeral 58 designates a gas tank of an inert gas, connected to the perforated pipes 56 through conduits 59.

The ladling chamber 60 in which the melted metal for the mold is fed has an upper opening through which the melted metal can be ladled. In the illustrated embodiment, the ladling chamber 60 is connected to the gas treatment chamber 50 and bounds on the holding chamber 40 through the insulating separation wall 65.

Figure 4:
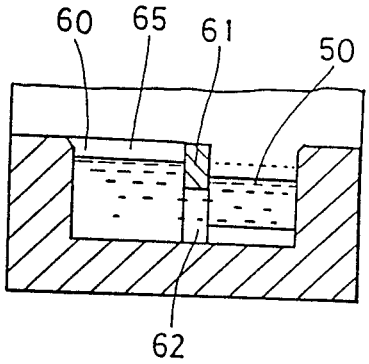
FIG. 4 is a sectional view taken along the line 4—4 in FIG. 1.
Figure 5:
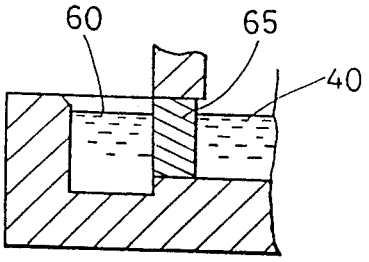
FIG. 5 is a sectional view taken along the line 5—5 in FIG. 1.

Thus, the ladling chamber 60 is bound to the gas treatment chamber 50 through a separation wall 61, as shown in FIG. 4. The separation wall 61 is provided on its lower portion with a connecting hole 62 to connect the ladling chamber 60 to the gas treatment chamber 50. Preferably, the connecting hole 62 is located at a level lower than the surface of the melted metal to prevent impurities, such as oxides or the like floating on the surface of the melted metal from entering the ladling chamber 60, similarly to the above-mentioned connecting hole 52. The lower connecting holes 52 and 62 clean the melted metal.

The ladling chamber 60 bounds on the holding chamber 40 through an insulating spearation wall 65. The separation wall is made of refractory material having a high heat conductivity, such as silicon nitride bonded silicon carbide grain which is well known. Silicon nitride bonded silicon carbide grain has a high strength due to silicon nitride and a high thermal conductivity (14.1, (1200° C.) Kcal/m/hr/°C.) several times the conventional aluminium refractories. In the illustrated embodiment, the thickness of the separation wall 65 is smaller by about 50 mm than that (230 mm) of the body portion of the separation wall. Supposing that the temperature of the melted metal in the holding chamber 40 is 740° C., the temperature of the melted metal in the ladling chamber 60 is about 710° C. due to the presence of the insulating separation wall. Namely, there is only a small temperature difference of about 3° C. between the ladling chamber 60 and the holding chamber 40. Note that there was a temperature difference of about 100° C. in the prior art, as mentioned before.

Numeral 70 in FIG. 3 designates a combustion unit.

The furnace of the present invention operates as follows.

First, the melting burner 39 and the additional burner 49 in the furnace are ignited to heat the melting tower chamber 20, the inclined floor chamber 30 and the holding chamber 40.

The heat gas of the melting burner 39 ascends from the lower portion of the melting tower chamber 20 toward the discharge port. On the other hand, the heat gas of the holding burner 49 circulates in the holding chamber 40 and then enters the inclined floor chamber 30 through the connection hole 40 of the holding chamber 42 and thereafter ascends from the lower portion of the melting tower chamber 20 toward the discharge port thereof.

After that, the aluminium material A, such as an aluminium ingot is fully poured into the melting tower chamber 20 through the upper pouring opening 21 which is opened by opening the cover 24.

The lower portion of the aluminium material A stacked in the melting tower chamber 20 is heated and melted by the heat gas of the melting burner 39. At the same time, the upper portion A2 of the aluminium material A comes into thermal contact with the exhaust gas of the melting burner 39 and the exhaust gas of the additional burner 39, so that the upper portion A2 of the aluminium material A is preheated by the exhaust gases due to heat exchange. Thus, the heat energy of the burners in the furnace is effectively utilized.

The metal melted in the melting tower chamber 20 flows onto the inclined floor surface 33 of the inclined floor chamber 30 through the bottom surface 28 of the melting tower chamber 20.

The melted metal discharged into the inclined floor chamber 30 is heated by the burner flame of the melting burner 39 and the heat gas of the additional burner 49 during the movement on the inclined floor surface 33.

The metal which is fully heated and completely melted enters the holding chamber 40 through the connecting opening 42, so that the melted metal is reserved in the holding chamber 40.

The temperature of the melted metal in the holding chamber 40 is controlled by the additional burner 49.

The gas contained in the melted metal is removed in the gas treatment chamber 50 which is connected to the holding chamber 40 through the connection opening 52. The gas treatment chamber 50 is adapted only to remove the gas contained in the melted metal. As mentioned before, it is possible to increase the number of perforated pipes 56 in order to enhance the efficiency of the bubbling device.

The melted metal with removed gas enters the ladling chamber 60 which bounds on the holding chamber 40 through the insulating separation wall, so that the temperature of the melted metal is maintained in the holding chamber. Thus, the high quality melted metal having a high temperature can be fed to the mold.

As can be seen from the foregoing, according to the present invention, sin:e a gas treatment chamber is independently provided, a bubbling device having a desired efficiency of removal of gas contained in the melted metal can be arranged in the gas treatment chamber to effectively remove hydrogen gas or the like from the melted metal. Furthermore, since the ladling chamber which is located on the downstream side from the gas treatment chamber bounds on the holding chamber through the insulating separation wall, almost no decrease of temperature of the melted metal in the ladling chamber takes place. This results in a decreased difference in temperature between the holding chamber and the ladling chamber, so that it is not necessary to maintain the temperature of the melted metal in the holding at a higher temperature than that in the ladling chamber. As a result, a heat energy can be effectively utilized, resulting in a decreased fuel consumption.

In a furnace according to the present invention, the quality and the temperature can be precisely and advantageously effected.

I claim:

1. A continuous metal melting furnace comprising:

a melt tower chamber in which metal to be melted can be stacked and melted;

an inclined floor chamber connected to said melting tower chamber and having an inclined bottom surface;

a holding chamber connected to said inclined floor chamber and in which said melted metal is held;

a gas treatment chamber connected to said holding chamber and having a bubbling device for ejecting an inert gas into said melted metal; and a ladling chamber connected to said gas treatment chamber and bounded on said holding chamber through a thermally insulative connecting wall.

2. A continuous metal melting furnace according to claim 1, wherein said bubbling device comprises at least one perforated pipe for ejecting an inert gas into said melted metal.

3. A continuous metal melting furnace according to claim 1, wherein said melting tower chamber has an upper metal port through which said metal to be melted can be fed.

4. A continuous metal melting furnace according to claim 3, wherein said inclined floor surface has a first floor portion and a second floor portion extending in a direction at right angle to said first floor portion for changing the direction of flow of said melted metal.

5. A continuous metal melting furnace according to claim 4, wherein said thermally insulative wall has a connecting opening which connects said holding chamber and said ladling chamber.

6. A continuous melting furnace according to claim 5, wherein said connecting opening of said thermally insulative separation wall is located at a level lower than the upper surface level of said melted metal held in a normal state in said holding chamber.

7. A continuous metal melting furnace according to claim 6, wherein said holding chamber has a bottom lower than said inclined bottom surface of said inclined floor surface.

8. A continuous metal melting furnace according to claim 1, further comprising a burner in said melting tower for heating said metal in said melting tower chamber.

9. A continuous metal melting furnace according to claim 8, further comprising a second burner in said holding chamber for heating said melted metal in said holding chamber.

10. A continuous metal melting furnace according to claim 1, wherein said holding chamber is bounded by said gas treatment chamber by a thermally insulative separation wall.

11. A continuous metal melting furnace according to claim 10, wherein said thermally insulative separation wall has a connecting opening which connects said holding chamber and said gas treatment chamber.

12. A continuous metal heating furnace according to claim 11, wherein said connecting opening in said thermally insulative separation wall between said holding chamber and said gas treatment chamber is located at a level lower than the upper surface level of said melted metal held in a normal state in said holding chamber.

13. A continuous metal melting furnace according to claim 11, wherein said thermally insulative separation wall between said holding chamber and said ladling chamber is made of silicon nitride bonded silicon carbide refractories.

14. A continuous metal melting furnace according to claim 3, further comprising a movable cover for normally closes said upper metal pouring port of said melting tower chamber.

* * * * *